US005775405A

United States Patent [19]

Boussa

[11] Patent Number: 5,775,405

[45] Date of Patent: Jul. 7, 1998

[54] AIR PREHEATER BASKET ASSEMBLY

[75] Inventor: Vong Boussa, Wellsville, N.Y.

[73] Assignee: ABB Air Preheater, Inc., Wellsville, N.Y.

[21] Appl. No.: 745,097

[22] Filed: Nov. 7, 1996

[51] Int. Cl.[6] ..... F23L 15/02

[52] U.S. Cl. ..... 165/8; 165/10

[58] Field of Search ..... 165/8, 10, 6, 9

[56] References Cited

U.S. PATENT DOCUMENTS

| | | | |
|---|---|---|---|
| 1,762,446 | 6/1930 | Ljungström | 165/10 X |
| 3,379,240 | 4/1968 | Woolard et al. | 165/10 |
| 3,465,815 | 9/1969 | Wheeler | 165/10 |
| 5,048,595 | 9/1991 | Harder | 165/10 X |

FOREIGN PATENT DOCUMENTS

| | | | |
|---|---|---|---|
| 1397214 | 1/1964 | France | 165/8 |
| 0865625 | 2/1953 | Germany | 165/10 |
| 1060539 | 7/1959 | Germany | 165/8 |
| 1136048 | 9/1962 | Germany | 165/10 |
| 0109076 | 8/1964 | Netherlands | 165/8 |
| 0767665 | 2/1957 | United Kingdom | 165/10 |

*Primary Examiner*—John Rivell
*Assistant Examiner*—Christopher Atkinson
*Attorney, Agent, or Firm*—Alix, Yale & Ristas, LLP

[57] ABSTRACT

A rotary regenerative air preheater has a heat exchange basket assembly comprising one keystone heat exchange basket disposed between two lateral heat exchange baskets in each outboard sector compartment. The baskets have a trapezoidal shape such that the parallel sides of the keystone heat exchange basket and each lateral basket define the inboard and outboard faces of each basket. Heat exchange elements are loaded into the baskets such that they extend parallel to the parallel sides of each basket. Since the baskets have a trapezoidal shape, the width of the elements in the keystone heat exchange basket and the lateral heat exchange baskets are progressively reduced from the outboard face to the inboard face.

20 Claims, 6 Drawing Sheets

AIR PREHEATER BASKET ASSEMBLY

BACKGROUND OF THE INVENTION

The present invention relates generally to rotary heat exchangers and, more specifically, to baskets for containing the heat transfer elements.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a central rotor post and divided into a plurality of pie-shaped sectors by a plurality of radial partitions, known as diaphragms, extending from the rotor post to the outer peripheral shell of the rotor. Each rotor sector is further subdivided into generally trapezoidal-shaped compartments by stay plates which are positioned in radially spaced relationship between the rotor post and the rotor shell. The outermost compartment is distinct, in that the rotor shell, which is curved at a radius from the rotor post, defines the outboard wall of the outer compartment.

In most conventional air preheaters, each compartment, or at least the outboard compartments, is loaded with a pair of heat exchange baskets. Each heat exchange basket contains a mass of heat absorbent material commonly comprised of stacked plate-like elements. The pair of heat exchange baskets are shaped to fit the compartments. Therefore, the pairs of heat exchange baskets for the outermost compartments have a modified trapezoidal shape wherein the outboard wall is bowed outwardly.

In some conventional air preheaters, the outboard compartments are loaded with three heat exchange baskets, wherein a single square basket is disposed intermediate two trapezoidal-shaped lateral baskets. The square basket extends to the rotor shell, thereby filling a portion of the bypass flow area. Although such structure reduces the bypass flow area, the remaining bypass flow area is sufficiently large to require the use of bypass bars or L-shaped clips as explained below.

Typically, the heat exchange elements are stacked in the heat exchange baskets such that each plate-shaped element extends vertically and from side-to-side of the heat exchange basket. Each element has a plurality of vertically extending creases. Each crease defines a ridge on one side of the element and a groove on the opposite side of the element. The ridges engage the surface of an adjacent element, causing the elements to be spaced from each other creating a passageway for the flow of the flue gas and combustion air. In order to fill the volume of the segment inside of the curved outer cover plate of the outboard heat exchange baskets, the width of the heat exchange elements is progressively reduced in conventional air preheaters. When the heat exchange basket has loose-packed elements, the shorter elements used to fill the volume inside of the cover plate are free to move. Such movement can result in nesting of the elements, wherein the ridges of one element nest in the grooves of an adjacent element. Such nesting closes some channels and reduces the heat transfer surface area and creates a flow bypass gap.

Conventional air preheaters may utilize a bypass bar, which is welded to the basket cover, to block or reduce the bypass flow area. Alternatively, they may use L-shaped clips to lock the elements in place, preventing movement and nesting of the elements. The bypass bar creates an added pressure drop through the air preheater. The significance of this additional pressure drop depends on the size of the air preheater. The L-shaped clips provide additional heat transfer area. However the combination of heat exchange elements and clips leaves an unacceptable amount of bypass area.

SUMMARY OF THE INVENTION

The present invention relates to a novel heat exchange basket design that reduces the flow bypass area between the outboard chord of the outboard heat exchange basket and the rotor shell. More specifically, the heat exchange elements in two laterally spaced heat exchange baskets and a single keystone heat exchange basket disposed intermediate the laterally spaced heat exchange baskets substantially fill the volume defined by the curved rotor shell.

DESCRIPTION OF THE PREFERRED EMBODIMENT

Figure 1:
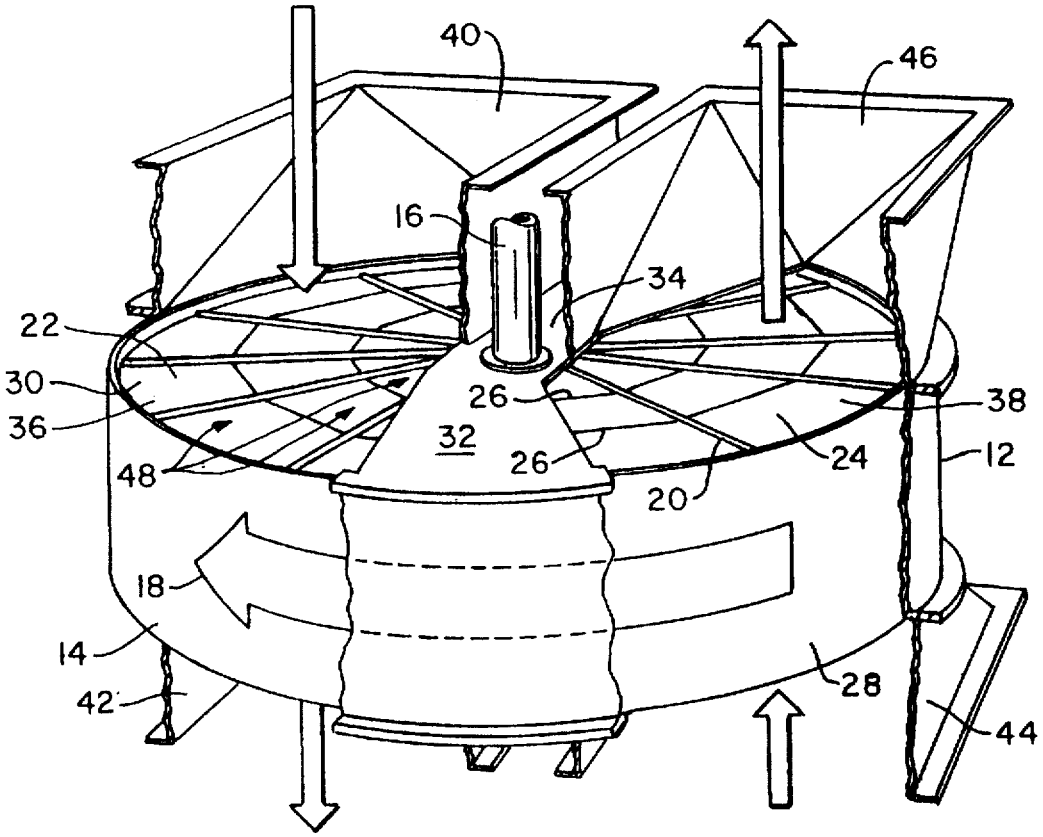
FIG. 1 PRIOR ART
FIG. 1 is a general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of diaphragms 20 that define a plurality of pie-shaped sectors 22. Each sector 22 is sub-divided into generally trapezoidal-shaped compartments 24 by stay plates 26 which are positioned in radially spaced relationship between the rotor post 16 and the rotor shell 28. The outermost compartments 30 are distinct, in that the rotor shell 28, which is curved at a radius from the rotor post 16, defines the outboard wall of the outer compartment 30.

The housing 12 is divided by means of flow impervious sector plates 32, 34 into a flue gas side 36 and an air side 38. A corresponding sector plate is also located on the bottom of the unit. The hot flue gases enter the air heater through the gas inlet duct 40, flow through the rotor where heat is transferred to the rotor and then exit through gas outlet duct 42. The countercurrent flowing air enters through air inlet duct 44, flows through the rotor where it picks up heat and then exits through air outlet duct 46.

Figure 2:
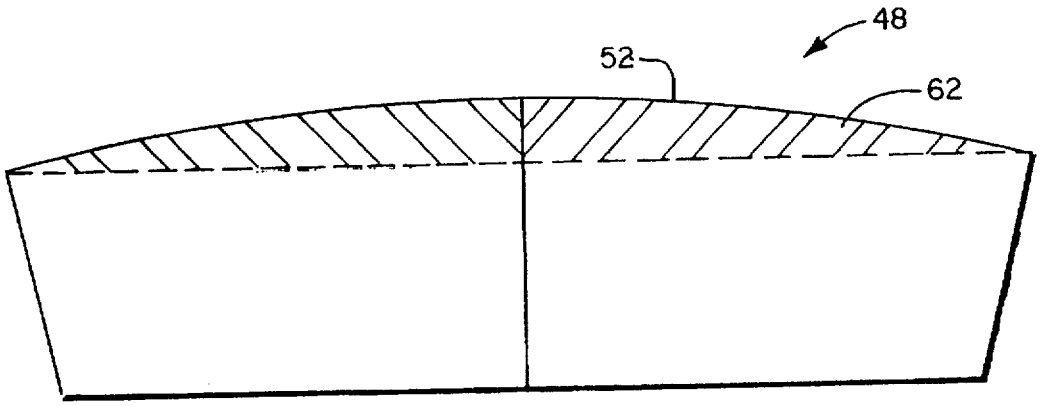
FIG. 2 PRIOR ART
FIG. 2 is an enlarged top view of a pair of prior art outboard heat exchange baskets, with the heat exchange elements removed, illustrating the chord area defined by the outboard cover plate.

In most conventional air preheaters, each outboard compartment 30 is loaded with a pair of heat exchange baskets 48. Each heat exchange basket 48 contains a mass of heat absorbent material commonly comprised of stacked plate-like elements 50. The pair of heat exchange baskets 48 are shaped to fit the compartments 24. Therefore, the pairs of heat exchange baskets 48, for the outermost compartments 30 have a modified trapezoidal shape wherein the outboard wall or cover plate 52 is bowed outwardly, as shown in FIGS. 2, 3 and 4.

Typically, the heat exchange elements 50 are stacked in the heat exchange baskets 48 such that each plate-shaped element 50 extends vertically and from side-to-side of the heat exchange basket 48. As shown in FIG. 5, each element 50, 50' has a plurality of vertically or diagonally extending creases 54, 54'. Each crease 54, 54' defines a ridge 56, 56' on one side of the element 50, 50' and a groove 58, 58' on the opposite side of the element 50, 50'. The ridges 56' engage the surface of an adjacent element 50, causing the elements 50, 50' to be offset from each other, thereby creating a passageway 60 for the flow of the flue gas and combustion air. In order to fill the volume 62 inside the curved cover plate 52 of the outboard heat exchange baskets 48, the width W of the heat exchange elements 50 is progressively reduced in conventional air preheaters, as shown in FIG. 4. When the heat exchange basket 48 has loose-packed elements, the shorter elements which were used to fill the volume under the cover plate 52 are free to move. Such movement can result in nesting of the elements 64, 64', wherein the ridges 66 of one element 64 nest in the grooves 68 of an adjacent element 64', as shown in FIG. 5. Such nesting reduces or eliminates the passageway, reduces the effective heat transfer surface area, and creates a flow bypass gap.

Figure 3:
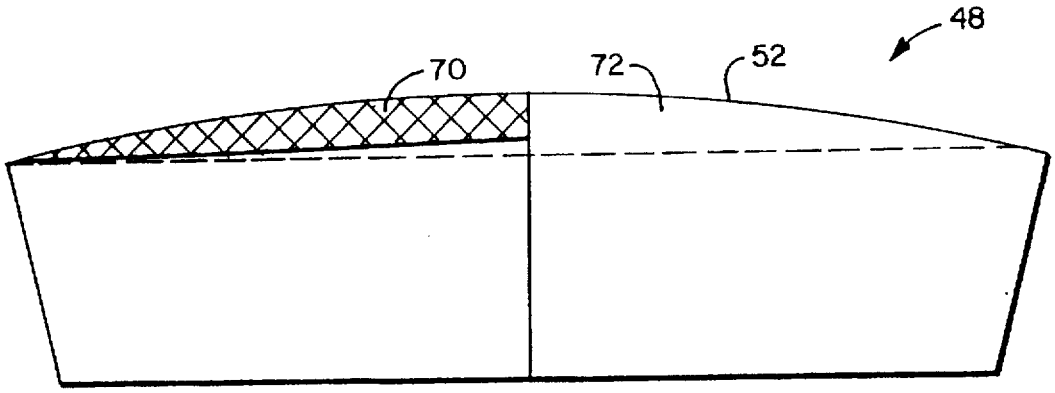
FIG. 3 PRIOR ART
FIG. 3 is an enlarged top view of the prior art outboard heat exchange baskets of FIG. 2 illustrating a bypass bar.
Figure 4:
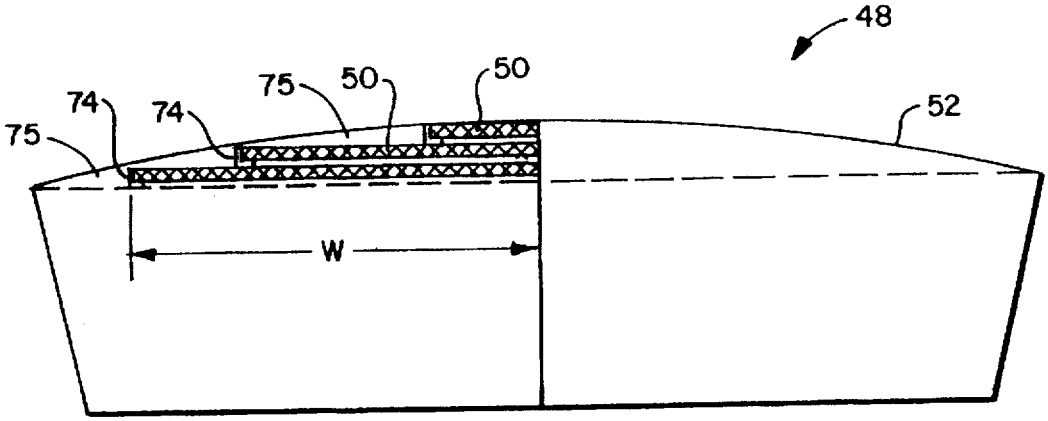
FIG. 4 PRIOR ART
FIG. 4 is an enlarged top view of the prior art outboard heat exchange baskets of FIG. 2 illustrating the reduced width heat exchange elements and element clips disposed in the chord area.
Figure 5:
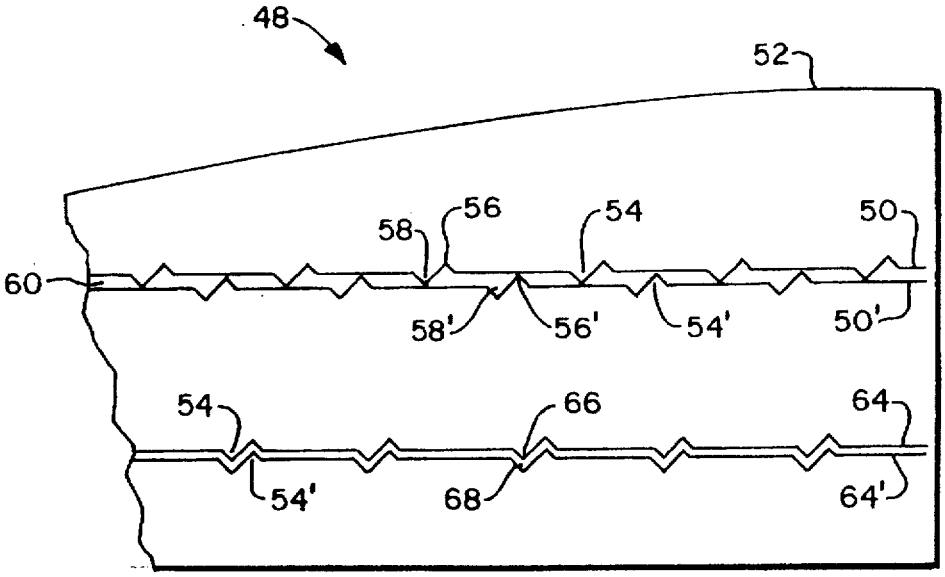
FIG. 5 PRIOR ART
FIG. 5 is an enlarged top view of one of the prior art outboard heat exchange baskets of FIG. 2 illustrating properly stacked heat exchange elements and nested heat exchange elements.

With reference to FIGS. 3 and 4, conventional air preheaters have utilized a bypass bar 70, which is welded to the basket cover 52, to block or reduce the bypass flow area 72. The bypass bar 70 creates a added pressure drop through the air preheater. The significance of this additional pressure drop depends on the size of the air preheater. Alternatively, conventional air preheaters have used L-shaped clips 74 to lock the elements 50 in place, preventing movement of the elements 50. The L-shaped clips 74 provide additional heat transfer area. However the combination of heat exchange elements 50 and clips 74 leaves an unacceptable amount of bypass area 75.

Figure 8A:
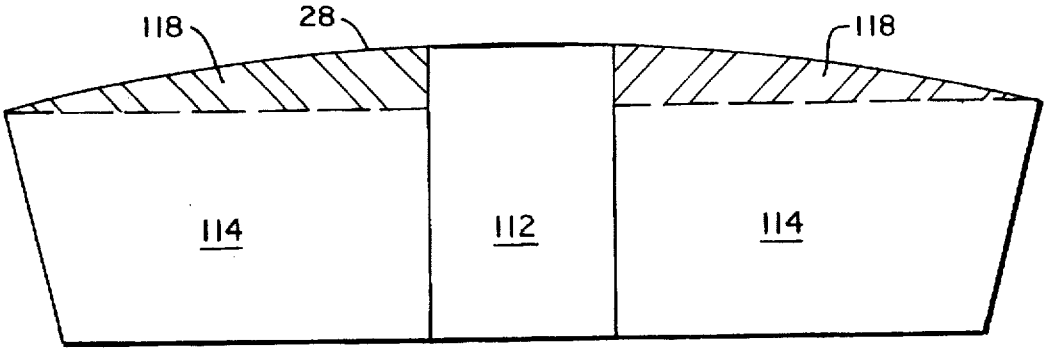
FIG. 8a PRIOR ART
FIGS. 8*a* to 8*c* are enlarged top views of three prior art outboard sector compartments and heat exchange basket assemblies, showing a square heat exchange basket and two lateral heat exchange baskets, with the heat exchange elements removed, in each compartment.
Figure 8B:
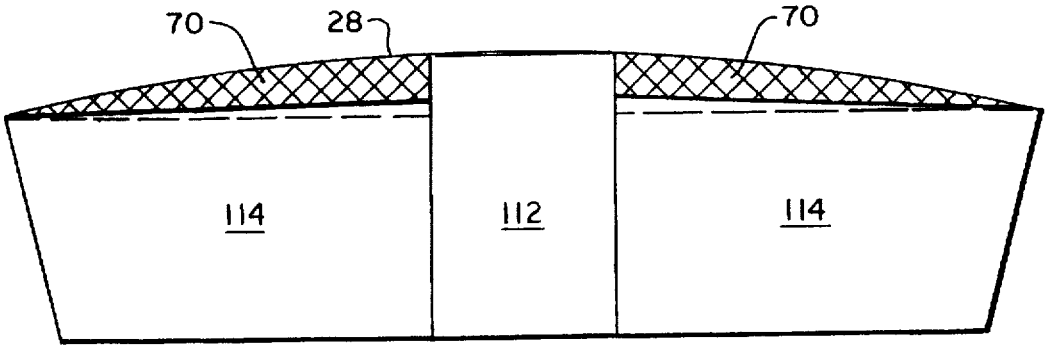
FIG. 8b PRIOR ART
Figure 8C:
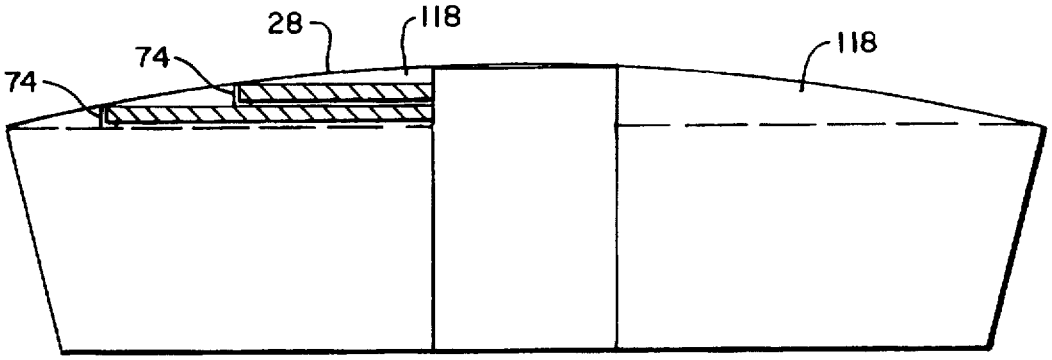
FIG. 8c PRIOR ART

In some conventional air preheaters, the outboard compartments 30 are loaded with three heat exchange baskets 112, 114, wherein a single square basket 112 is disposed intermediate two trapezoidal-shaped lateral baskets 114, as shown in FIGS. 8*a*–8*c*. The square basket 112 extends to the rotor shell 28, thereby filling a portion of the bypass flow area. Although such structure reduces the bypass flow area, the remaining bypass flow area 118 is sufficiently large to require the use of bypass bars 70 or L-shaped clips 74.

Figure 6:
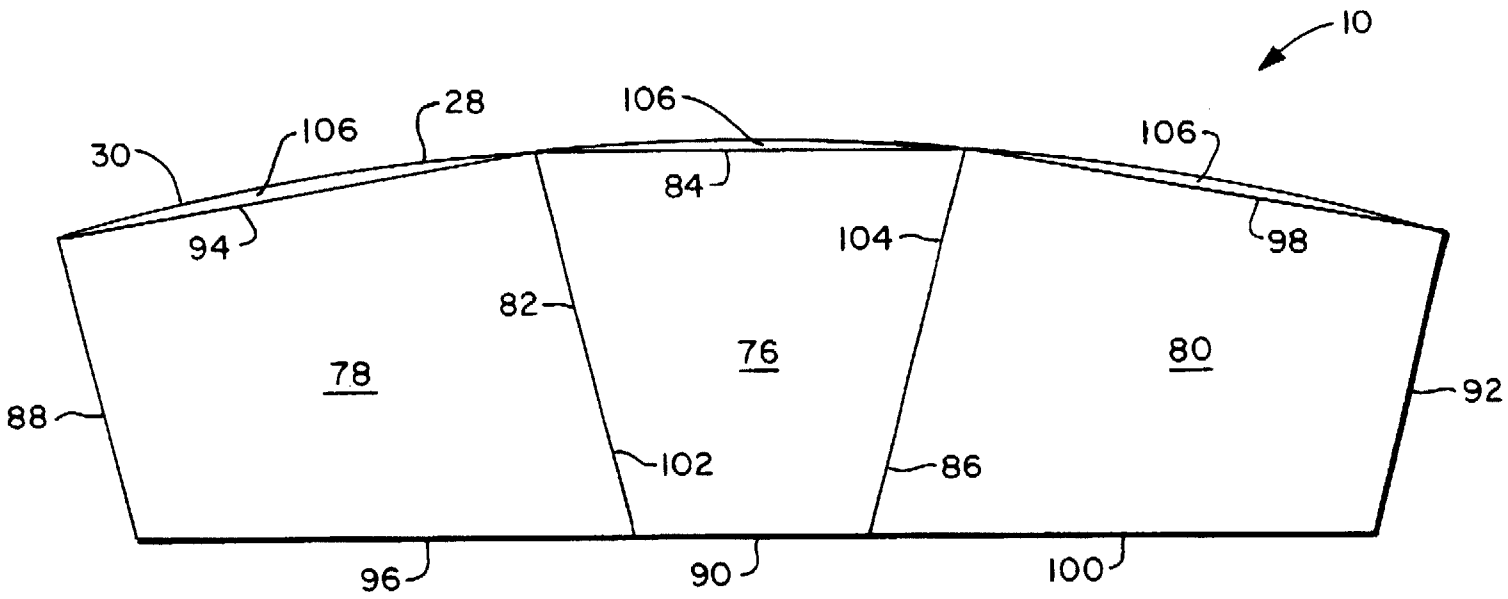
FIG. 6 is an enlarged top view of the outboard sector compartment and a heat exchange basket assembly in accordance with the present invention, with the heat exchange elements removed.

With reference to FIG. 6, a heat exchange basket 10 assembly in accordance with the present invention employs a keystone heat exchange basket 76 and two lateral heat exchange baskets 78, 80 to fill each outboard sector compartment 30. The keystone and lateral heat exchange baskets 76, 78, 80 each have a trapezoidal shape, wherein the length of one parallel side 84, 82, 86 of each basket 76, 78, 80 is greater than the length of the other parallel side 90, 88, 92 of the basket 76, 78, 80. The parallel sides 90, 84 of the keystone heat exchange basket 76 define the inboard and outboard faces of the basket 76, where the "inboard" side is the narrow side and the "outboard" side is the wide side, and the non-parallel sides 102, 104 define the side faces of the basket 76. The parallel sides 88, 92, 82, 86 of the lateral heat exchange baskets 78, 80 define the inboard and outboard faces of each basket 78, 80 and the non-parallel sides 96, 100, 94, 98 define the side faces of each basket 78, 80. The keystone heat exchange basket 76 is positioned between the two lateral heat exchange baskets 78, 80 such that one of the parallel side faces 82, 86 of each lateral heat exchange basket 78, 80 is adjacent to a non-parallel side face 102, 104 of the keystone heat exchange basket 76. The length of the non-parallel sides 102, 104 of the keystone heat exchange basket 76 are substantially equal to the length of the longer parallel side 82, 86 of the lateral heat exchange baskets 78, 80. As shown in FIG. 6, the flow bypass area 106 between the baskets 76, 78, 80 and the rotor shell 28 is very small.

Figure 7:
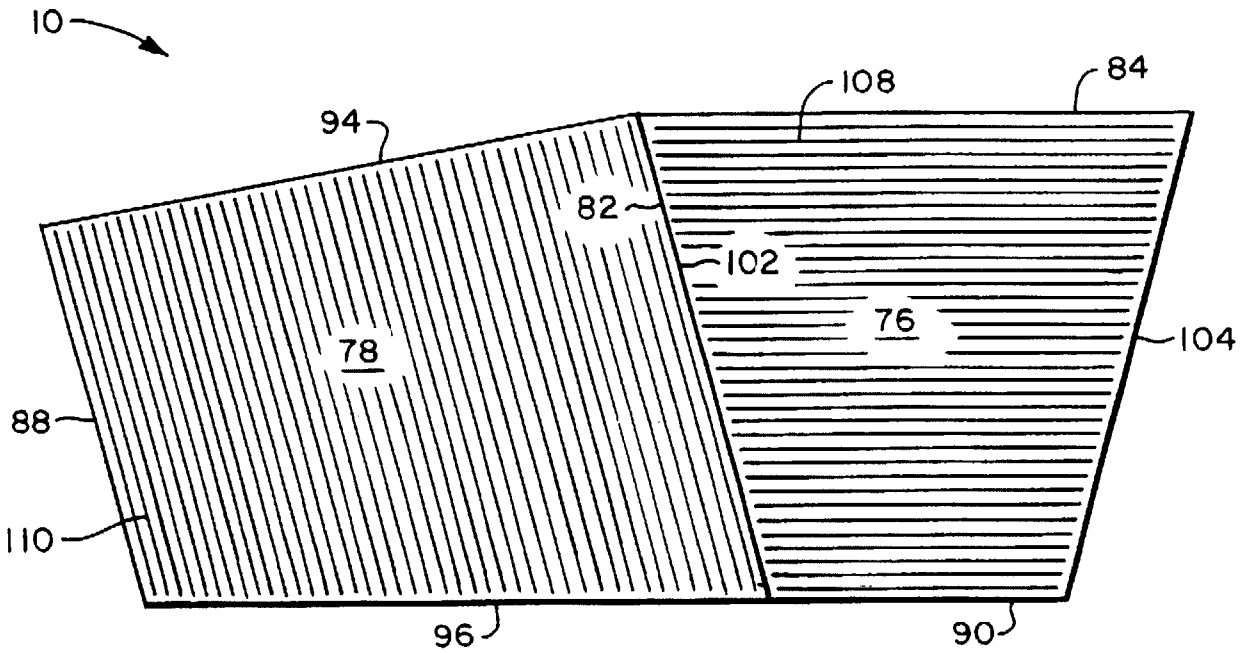
FIG. 7 an enlarged top view of one of the lateral heat exchange baskets and the keystone heat exchange basket of FIG. 6 illustrating the orientation of the heat exchange elements contained therein.

With reference to FIG. 7, the heat exchange elements 108, 110 are loaded into the keystone and lateral heat exchange baskets 76, 78 such that they extend parallel to the parallel sides of the basket 84, 90, 82, 88. Since the heat exchange baskets 76, 78 have a trapezoidal shape, the width of each heat exchange element 108, 110 is determined by the distance between the non-parallel sides 102, 104, 94, 96 at the level for the specific heat exchange element. Consequently, for the keystone heat exchange basket 76 the width is progressively reduced from the outboard face 84 to the inboard face 90 and for the lateral heat exchange baskets 78, 80 the width is progressively reduced from longer side face 82, 86 to the shorter side face 88, 92. Preferably, each heat exchange element 108, 110 extends from one non-parallel side 102, 96, 100 to the opposite non-parallel side 104, 94, 98 such that the side edges of the element 108, 110 are separated from the non-parallel sides 102, 104, 94, 96, 98, 100 of the basket 76, 78, 80 only by the clearance required for installation of the element 108, 110. Such construction provides a basket that has little or no internal bypass flow area.

It should be appreciated that keystone and lateral heat exchange baskets 76, 78, 80 in accordance with the present invention are adaptable to small and large air preheaters. The lengths of the parallel and non-parallel sides of the keystone and lateral baskets and the angles between the parallel and non-parallel sides may be adjusted to minimize the bypass flow area between the baskets and the rotor shell. So long as the inboard and outboard faces 90, 84 of the keystone heat exchanger basket 76 are parallel and the outboard and inboard faces 82, 86, 88, 92 of the lateral heat exchanger baskets 78, 80 are parallel, the flow bypass area internal to the baskets 76, 78, 80 shall be minimized.

We claim:

1. A heat exchange basket assembly for an air preheater comprising:

first and second lateral heat exchange baskets, each of the lateral heat exchange baskets comprising first and second parallel sides and first and second non-parallel sides; and a keystone heat exchange basket comprising first and second parallel sides and first and second non-parallel sides;

wherein the keystone heat exchange basket is positioned intermediate the first and second lateral heat exchange baskets, wherein the first non-parallel side of the keystone heat exchange basket is adjacent the first parallel side of the first lateral heat exchange basket and the second non-parallel side of the keystone heat exchange basket is adjacent the first parallel side of the second lateral heat exchange basket.

2. The heat exchange basket assembly of claim 1 wherein the first and second parallel sides of the first and second lateral heat exchange baskets each have a length, wherein the length of the first parallel side of each lateral heat exchange basket is greater than the length of the second parallel side of each lateral heat exchange basket.

3. The heat exchange basket assembly of claim 2 wherein the first and second non-parallel sides of the keystone heat exchange basket each have a length, wherein the length of the first non-parallel side of the keystone heat exchange basket is substantially equal to the length of the first parallel side of the first lateral heat exchange basket and the length of the second non-parallel side of the keystone heat exchange basket is substantially equal to the length of the first parallel side of the second lateral heat exchange basket.

4. The heat exchange basket assembly of claim 1 wherein the first and second parallel sides of the keystone heat exchange basket each have a length, wherein the length of the first parallel side of the keystone heat exchange basket is greater than the length of the second parallel side of the keystone heat exchange basket.

5. The heat exchange basket assembly of claim 1 wherein the keystone heat exchange basket and the first and second lateral heat exchange baskets each further comprise a mass of heat exchange material disposed interiorly of the first and second parallel sides and the first and second non-parallel sides, the mass of heat exchange material comprising a plurality of plate-shaped heat exchange elements.

6. The heat exchange basket assembly of claim 5 wherein each of the heat exchange elements defines a plane and wherein the plane of each heat exchange element of the keystone heat exchange basket is substantially parallel to the first and second parallel sides of the keystone heat exchange basket.

7. The heat exchange basket assembly of claim 6 wherein the first and second parallel sides of the keystone heat exchange basket each have a length, wherein the length of the first parallel side of the keystone heat exchange basket is greater than the length of the second parallel side of the keystone heat exchange basket.

8. The heat exchange basket assembly of claim 7 wherein each of the heat exchange elements extends substantially from the first non-parallel side to the second non-parallel side of the keystone heat exchange basket, defining a width for each heat exchange element, wherein the width of the heat exchange elements is progressively reduced from the first parallel side of the keystone heat exchange basket to the second parallel side of the keystone heat exchange basket.

9. The heat exchange basket assembly of claim 5 wherein each of the heat exchange elements defines a plane and wherein the plane of each heat exchange element of each lateral heat exchange basket is substantially parallel to the first and second parallel sides of the lateral heat exchange basket.

10. The heat exchange basket assembly of claim 9 wherein the first and second parallel sides of the first and second lateral heat exchange baskets each have a length, wherein the length of the first parallel side of the each lateral heat exchange basket is greater than the length of the second parallel side of the each lateral heat exchange basket.

11. The heat exchange basket assembly of claim 10 wherein each of the heat exchange elements extends substantially from the first non-parallel side to the second non-parallel side of each lateral heat exchange basket, defining a width for each heat exchange element, wherein the width of the heat exchange elements is progressively reduced from the first parallel side of each lateral heat exchange basket to the second parallel side of each lateral heat exchange basket.

12. An air preheater comprising:

a rotor shell;

a plurality of outboard sector compartments having a portion of the rotor shell as an outboard wall;

first and second lateral heat exchange baskets disposed in each of the outboard sector compartments, each of the lateral heat exchange baskets comprising first and second parallel sides and first and second non-parallel sides, wherein the first parallel side of each lateral heat exchange basket defines an outboard side; and a keystone heat exchange basket positioned intermediate the first and second lateral heat exchange baskets in each of the outboard sector compartments, the keystone heat exchange basket comprising first and second parallel sides and first and second non-parallel sides, wherein the first parallel side of the keystone heat exchange basket defines an outboard side.

13. The heat exchange basket assembly of claim 12 wherein the keystone heat exchange basket and the first and second lateral heat exchange baskets each further comprise a mass of heat exchange material disposed interiorly of the first and second parallel sides and the first and second non-parallel sides, the mass of heat exchange material comprising a plurality of plate-shaped heat exchange elements, wherein each of the heat exchange elements defines a plane and wherein the plane of each heat exchange element of the keystone and lateral heat exchange baskets is substantially parallel to the first and second parallel sides of the keystone and lateral heat exchange baskets.

14. The heat exchange basket assembly of claim 13 wherein the first and second parallel sides of the keystone heat exchange basket each have a length, wherein the length of the first parallel side of the keystone heat exchange basket is greater than the length of the second parallel side of the keystone heat exchange basket.

15. The heat exchange basket assembly of claim 14 wherein each of the heat exchange elements extends substantially from the first non-parallel side to the second non-parallel side of the keystone heat exchange basket, defining a width for each heat exchange element, wherein the width of the heat exchange elements is progressively reduced from the first parallel side of the keystone heat exchange basket to the second parallel side of the keystone heat exchange basket.

16. The heat exchange basket assembly of claim 13 wherein the first and second parallel sides of the first and second lateral heat exchange baskets each have a length, wherein the length of the first parallel side of the each lateral heat exchange basket is greater than the length of the second parallel side of the each lateral heat exchange basket.

17. The heat exchange basket assembly of claim 16 wherein each of the heat exchange elements extends substantially from the first non-parallel side to the second non-parallel side of each lateral heat exchange basket, defining a width for each heat exchange element, wherein the width of the heat exchange elements is progressively reduced from the first parallel side of each lateral heat exchange basket to the second parallel side of each lateral heat exchange basket.

18. The heat exchange basket assembly of claim 12 wherein the first and second parallel sides of the first and second lateral heat exchange baskets each have a length, wherein the length of the first parallel side of each lateral heat exchange basket is greater than the length of the second parallel side of each lateral heat exchange basket.

19. The heat exchange basket assembly of claim 18 wherein the first and second non-parallel sides of the keystone heat exchange basket each have a length, wherein the length of the first non-parallel side of the keystone heat exchange basket is substantially equal to the length of the first parallel side of the first lateral heat exchange basket and the length of the second non-parallel side of the keystone heat exchange basket is substantially equal to the length of the first parallel side of the second lateral heat exchange basket.

20. The heat exchange basket assembly of claim 12 wherein the first and second parallel sides of the keystone heat exchange basket each have a length, wherein the length of the first parallel side of the keystone heat exchange basket is greater than the length of the second parallel side of the keystone heat exchange basket.

* * * * *